US008534271B2

(12) United States Patent
Bettendorf et al.

(10) Patent No.: US 8,534,271 B2
(45) Date of Patent: Sep. 17, 2013

(54) MICROPROSSESOR BASED VEHICLE EJECTION DEVICE USED TO DEFLATE TIRES

(76) Inventors: Leonard Jon Bettendorf, Gilbert, AZ (US); Lynn Marie Bettendorf, Mesa, AZ (US)

( * ) Notice: Subject to any disclaimer, the term of this patent is extended or adjusted under 35 U.S.C. 154(b) by 204 days.

(21) Appl. No.: 13/222,167

(22) Filed: Aug. 31, 2011

(65) Prior Publication Data

US 2012/0060812 A1 Mar. 15, 2012

Related U.S. Application Data

(60) Provisional application No. 61/381,374, filed on Sep. 9, 2010.

(51) Int. Cl.
*F41B 11/06* (2006.01)

(52) U.S. Cl.
USPC ..... 124/56; 404/6

(58) Field of Classification Search
USPC ..... 124/56–77, 1; 404/6
See application file for complete search history.

(56) References Cited

U.S. PATENT DOCUMENTS

| | | | | |
|---|---|---|---|---|
| 5,330,285 | A * | 7/1994 | Greves et al. | 404/6 |
| 5,452,962 | A * | 9/1995 | Greves | 404/6 |
| 5,775,832 | A * | 7/1998 | Kilgrow et al. | 404/6 |
| 5,820,293 | A * | 10/1998 | Groen et al. | 404/6 |
| 6,155,745 | A * | 12/2000 | Groen et al. | 404/6 |
| 7,056,054 | B1 * | 6/2006 | Keith et al. | 404/6 |
| 7,377,715 | B2 * | 5/2008 | Kruise | 404/6 |
| 8,087,847 | B2 * | 1/2012 | Scott | 404/6 |

* cited by examiner

*Primary Examiner* — Michael David
(74) *Attorney, Agent, or Firm* — Bernard S. Hoffman

(57) ABSTRACT

An ejection device attaches to a push-bar of a first vehicle and deflates tires of a second vehicle. The device includes a housing, a propelling system, and a microprocessor. The housing is attached to the push-bar of the first vehicle, and contains at least one hollow triangular tube filled with sharp metal multi-directional spiked quills. The propelling system ejects the at least one hollow triangular tube filled with sharp metal multi-directional spiked quills out of the housing. The microprocessor controls a firing sequence of events to fire the at least one hollow triangular tube filled with sharp metal multi-directional spiked quills out of the housing.

17 Claims, 7 Drawing Sheets

MICROPROSSESOR BASED VEHICLE EJECTION DEVICE USED TO DEFLATE TIRES

BACKGROUND OF THE INVENTION

Currently in law enforcement, a popular method of stopping a vehicle being driven by a criminal suspect is to strategically place on a road section, where said vehicle will pass over, a contained supply of sharp protruding Teflon® coated metallic multi-directional spiked quills that act as valves, releasing air at a safe, controlled rate from a vehicle. A successful product using said Teflon® multi-directional spiked quills contained within a triangular plastic tube is STOP-STICK® as well as other similar and equivalent prior art method means.

Tire deflation devices are manually placed in the roadway by law enforcement personnel. During a pursuit, law enforcement personnel have to position themselves well ahead of the pursuit, retrieve the tire deflation device from the truck, and manually place the device in the path of the suspect vehicle. This current practice is also extremely dangerous to the law enforcement officer.

The present invention, referred to as a microprocessor based vehicle ejection device, can allow law enforcement officers to deploy into the path of a fleeing vehicle without leaving the safety of the vehicle. Said vehicle ejection device can allow the officer to employ the use of any vehicle stopping apparatus means, such as a STOP-STICK® or equivalent apparatus or a plurality of same while; (a) completely stopped, (b) moving in the same direction as the fleeing vehicle, or (c) while moving in the opposite as in an on-coming direction of the fleeing vehicle situation.

SUMMARY OF THE INVENTION

All aspects of the embodiments of present invention teaches that a safe method means of stopping any moving vehicle suspected as being involved in criminal activity, as in a vehicle chase situation or road block stance, is possible and is novel and patentable art of this present invention.

Further this present invention teaches, and should be obvious to anyone steeped in the art, that a projectile member means or plurality of projectile member means exits said present invention from either a moving or stopped law enforcement vehicle to travel through the air and land on a road surface in front of a suspect vehicle of pursuit; this being part and parcel to the function and operation of said present invention.

Further this present invention teaches that all control of arming, firing of projectiles, and system monitoring can automatically be executed under the control of a programmed microprocessor, which is the system control method means.

When a vehicle flees from law enforcement, short of ramming the fleeing vehicle, one way to stop the vehicle can be by using tire deflation devices. Said vehicle ejection device can eject hollow triangular shaped tubes filled with sharp multi-directional spiked quills towards the driver's side of the vehicle. The law enforcement officer(s) can use the device in different ways without exiting the police vehicle, such as when said police vehicle is in a stopped position with the fleeing vehicle either traveling in the same direction or on-coming to said police vehicle; when said police vehicle is in motion and said officer(s) is pursuing the vehicle, where said officer(s) can pull slightly ahead of and to the right side of said fleeing vehicle; and when said police vehicle is in motion and said fleeing vehicle approaching said police vehicle in an on-coming lane. If said vehicle ejection device is mounted on the front of said police vehicle a novel modified push-bar could be used to house and protect this device. Said present invention can be designed to mount on a push-bar collision safety member means, or can be designed to be mounted on any reasonable and effective area of a law enforcement vehicle for proper function and operation of said present invention.

Another aspect of embodiments of said present invention is for its mounting on any law enforcement vehicle as with a novel methodology of securely mounting said invention to said vehicle protective push-bar system and in electrical connection with, and controlled electronically by a novel control triggering switch member means inside of said law enforcement vehicle that has said present invention installed.

Another aspect of embodiments of said present invention is for the triggered firing of a singular hollow triangular tube filled with sharp metal multi-directional spiked quills or a plurality of hollow triangular tubes filled with sharp metal multi-directional spiked quills; with the plurality of firing method means, said firing can be a series sequence or simultaneous firing of all plurality of sharp multi-directional spiked quill filled triangular hollow tubes; whereby said hollow triangular tube(s) are housed for firing in a novel firing chamber method means, and all firing controlled by a programmed microprocessor method means.

Another aspect of embodiments of said present invention is for utilizing a novel gas filled cylinder or a plurality of gas filled cylinders as the projection force to launch effectively from said firing chamber method means, the hollow triangular tube filled with sharp metal multi-directional spiked quills.

Another aspect of embodiments of said present invention utilizes a novel safe operation method means under the control of a programmed microprocessor method means of triggered firing of a singular hollow triangular tube filled with sharp metal multi-directional spiked quills or a plurality of hollow triangular tubes filled with sharp metal multi-directional spiked quills using a fail-safe method means; whereby a safety latch member means covers the exit point of said hollow triangular tube(s) and prevents any pre-triggering by extraneous interference, either by physical method means or electrical so method means. Only by a valid command from within said law enforcement vehicle will fire said hollow triangular tube projectiles. Said triggered firing system means can be of a rapid plunger piston, a spring activated, or any other design means that will effectively launch a designated projectile or series of projectile onto a road surface for the purpose of stopping, by tire deflation, any suspect vehicle pursued by a law enforcement vehicle.

Another aspect of embodiments of said present invention utilizes a novel capability and method means for a simple procedure means for replacing discharged gas cylinder member means.

Another aspect of embodiments of said present invention utilizes a novel safety lock down cover member means to insure against unwarranted entry to said gas cylinder supply housing member means.

Another aspect of embodiments of said present invention utilizes a novel method means of securely containing said triangular hollow tubular projectiles against premature or false firing as a fail-safe means by utilizing a latched door method means at the front opening of said ejection chamber method means.

DETAILED DESCRIPTION OF DRAWINGS AND PREFERRED EMBODIMENTS

The following detailed description is of the best currently contemplated modes of carrying out exemplary embodiments of the invention. The description is not to be taken in a limiting sense, but is made merely for the purpose of illustrating the general principles of said present invention, since the scope of said present invention is best defined by the appended claims.

Figure 1:
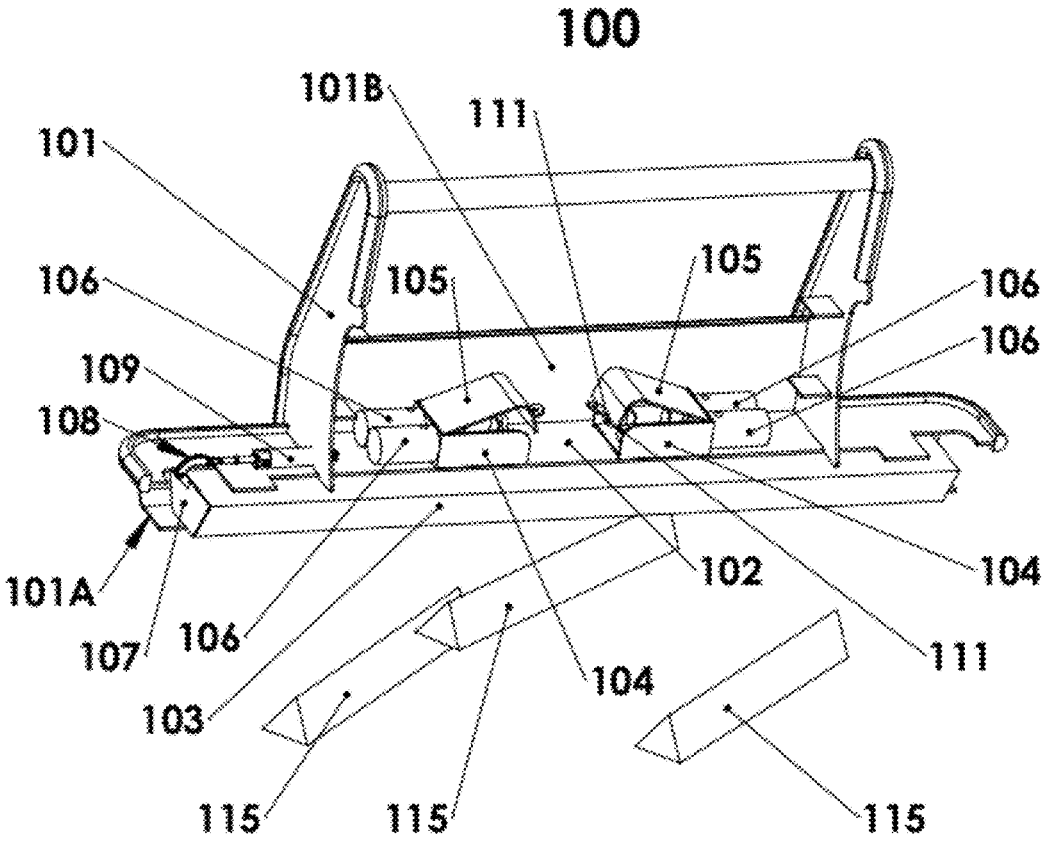
FIG. 1, is an overall perspective view of the present invention installed and mounted on a typical vehicle front end push-bar device.
Figure 2:
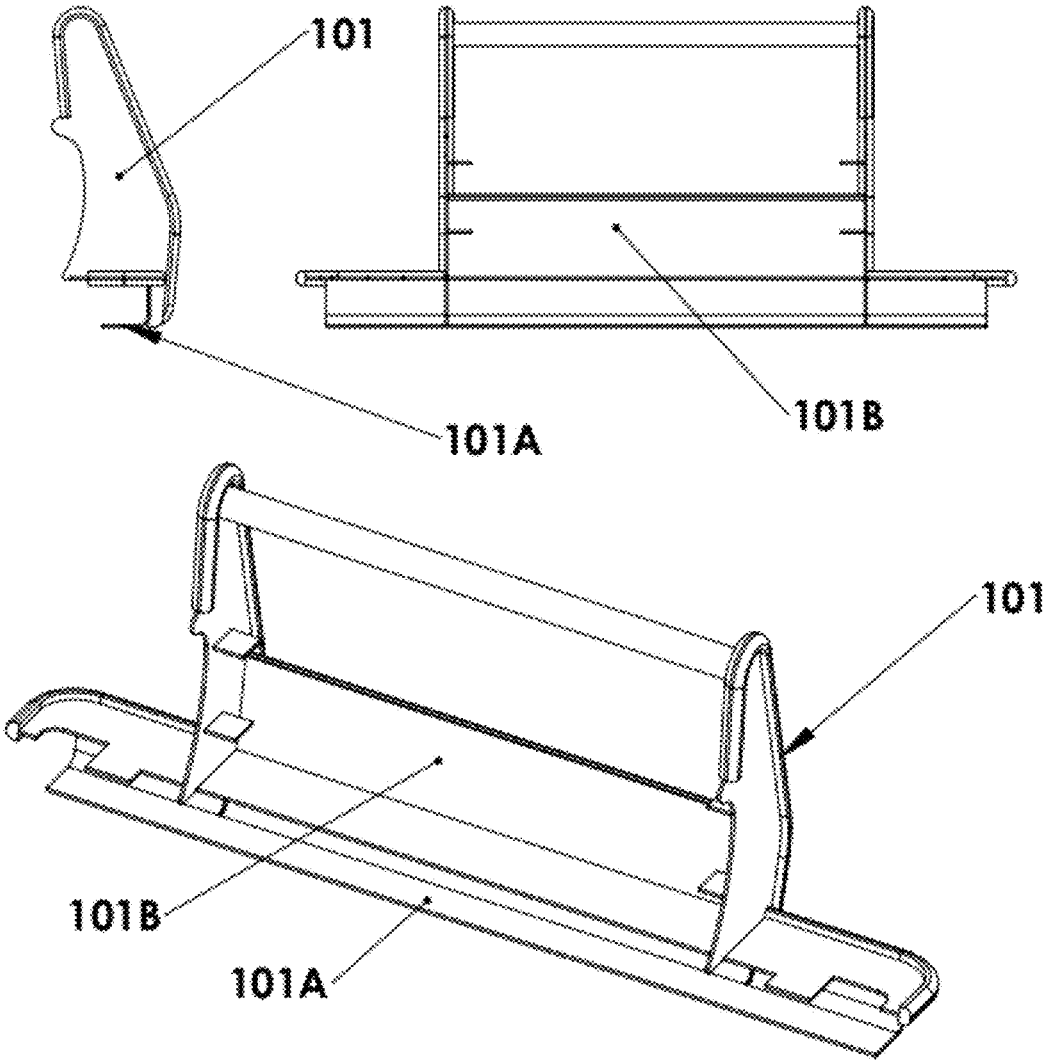
FIG. 2, is an illustration of a typical vehicle push-bar mechanism on which the present invention is installed and mounted.

An exemplary embodiment of said present invention 100 and its inherent novel features are shown in FIG. 1, as installed on a typical vehicle push-bar means 101, but not limited to this method means of positioning and installment on said vehicle. A mounting base method means 102 is mounted to the underside of a typical vehicle push-bar member means 101 and in addition, exists as a support substrate method means for said present invention's component member means comprised of; a chamber 103 for containing at least one, but not limited to one hollow triangular tube(s) member means 115 containing within, a supply of sharp multi-directional spiked quills utilized for tire deflation purposes as with a current product named STOP STICK® or any similar equivalent product; at least one, but not limited to one, gas cylinder container support member means 104; a protective lid covering member means 105; at least one or a plurality of gas cylinder firing solenoid member means 106 that instantly pierces and thereby instantly releases said contained gas within said cylinder member means 111 and said released gas is channeled via a flexible tube member means (not shown, but should be obvious to anyone steeped in the art), to a piston release system member means (internal to firing chamber 103 and should be obvious to anyone steeped in the art) that forces triangular projectiles 115 out of said firing chamber 103 that is shot out into the air and lands in front of a suspect vehicle with full intention of stopping said suspect vehicle in pursuit. A solenoid member means 109 moves latch member means 108 and opens safety door member means 107 and another set of internal firing chamber pistons method means (not shown but its importance and functioning in said present invention should be obvious to anyone steeped in the art) fire said triangular hollow tube member means 115, either all in sequence or all simultaneously. Said present invention 100, can be installed on any typical push-bar vehicle collision safety member means 101 with additional features of a protective guard member means 101A & 101B as shown in FIG. 1 & FIG. 2. Said protective member means 101A & 101B in FIG. 1 & FIG. 2 are present to prevent foreign objects such as dirt, road salt, and other objects that may compromise the functioning of said present invention.

Figure 3:
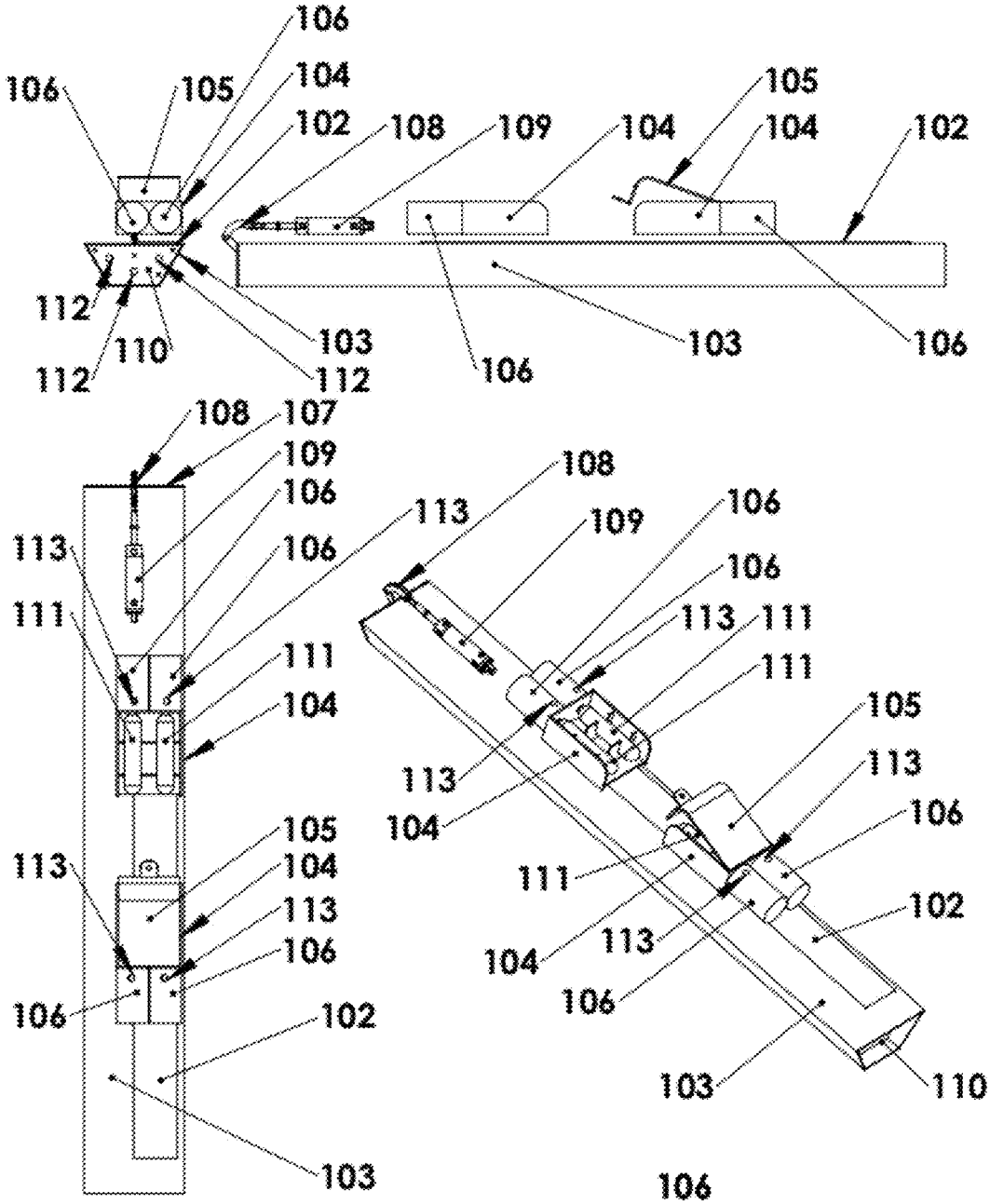
FIG. 3, is the complete stand-alone vehicle ejection device.

An embodiment of said present invention 100 of FIG. 1 is further detailed in FIG. 3; when in a typical situation of pursuit, with a criminal suspect fleeing and fighting all efforts by law enforcement officers in a dynamic police vehicle chase or a stationary police vehicle deterrent stance, there exists the need for utilizing said vehicle ejection device for tire deflation comes into play. In a fail-safe mode, as is the default condition of said vehicle based ejection system, said system is non operational in a safe de-triggered mode. Upon a command decision by a law enforcement officer, either as a driver or as a passenger, a pushbutton select switch within said police vehicle occupant interior is pushed and it sends a signal by a connecting cable to the exterior of said vehicle; which turns on, arms and activates said vehicle based projectile ejection tire deflating system.

An embodiment of the methodology associated with the various member means in FIG. 3 is by the action of; solenoid 109 being actuated and it re-tracks its plunger to pull up door 107 hold down latch 108 that readies and exposes said hollow triangular tube(s) 115 causing them to be available for a launch command. Said firing chamber member means 103 houses a single or a plurality of hollow triangular tube(s) 115; and said hollow triangular tube(s) 115 are set into and connected to a firing butt member means 110 that is connected to said firing chamber member means 103 at one end. Further, said firing butt member means 110 has a plurality of hole member means 112, which are connected in a closed circuitous fluidic manner means by a plurality of tubing member means (not shown in the figure) to a plurality of hole member means 113 on said plurality of gas cylinder firing solenoid member means 106 that is mounted and connected to said gas cylinder housing member means 104. Said gas filled cylinders 111 are screwed into said solenoid member means 106 for an air tight mechanical connection to said solenoid member means 106.

Figure 4:
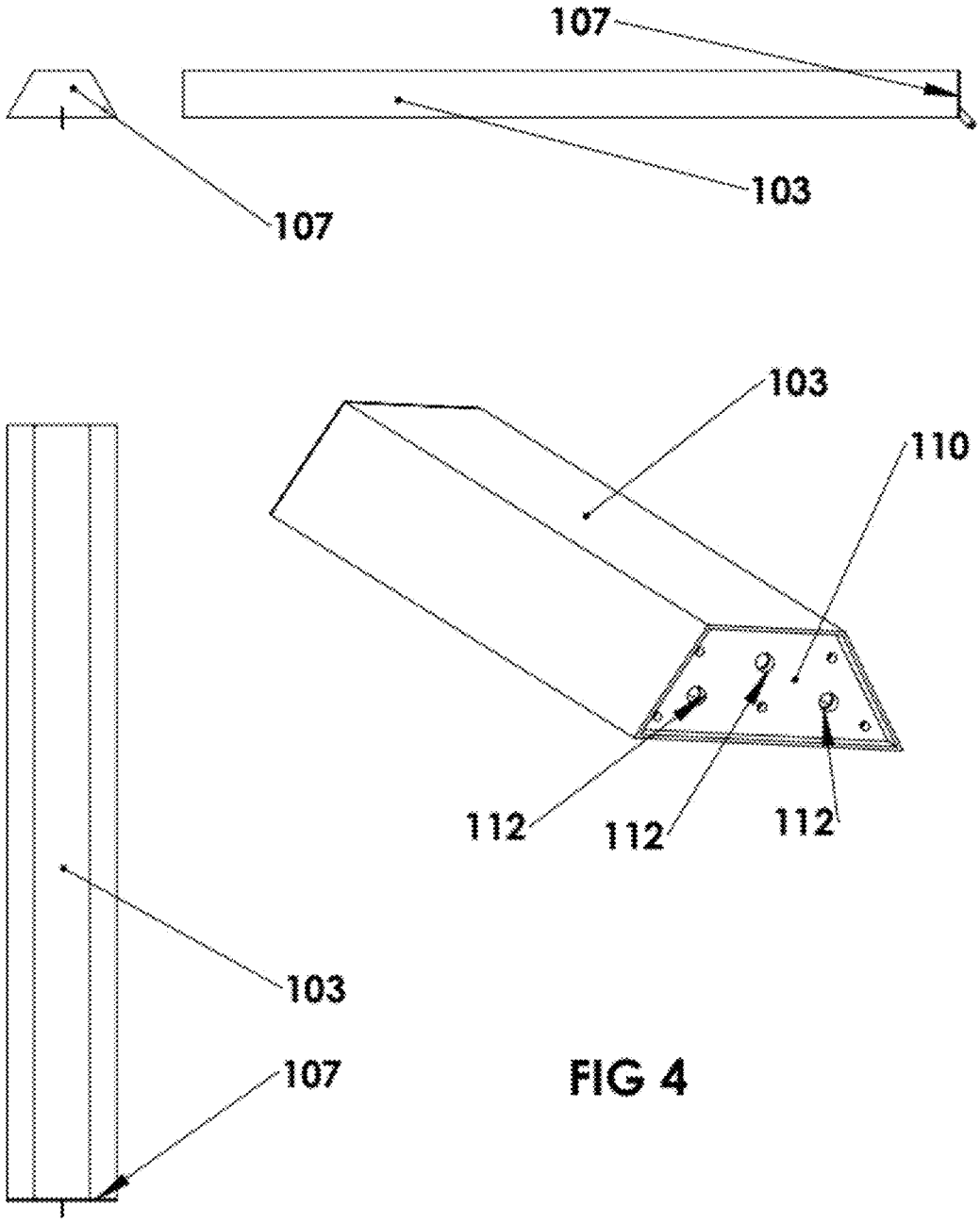
FIG. 4, is a perspective view of the firing chamber that stores for firing, triangular hollow sharp multi-directional spiked quill filled tubes.

Another embodiment of said present invention is in FIG. 4, with said triangular hollow tube member means 115 (hidden from view in this illustration, but represented in FIG. 1, FIG. 3, and FIG. 6) contained within said firing chamber member means 103 and secured within at both ends of said firing chamber member means 103 by said safety door 107 at one end and said firing butt retainer 110 at the opposite end of said firing chamber member means 103. Said input ports 112 are portal member means that are fitted with flexible tubing (not shown, but should be obvious to anyone steeped in the art) that are connected to said gas cylinder firing solenoids 106. Released gas from said solenoids 106 are channeled by said flexible tubing and enter with calculated and sufficient force that instantly forces triangular hollow tubes 115 out of said firing chamber member means 103 and are instantly launched into the air away from said law enforcement vehicle and onto a road surface armed and in a favorable position to stop any suspect vehicle in pursuit by law enforcement personnel.

Figure 5:
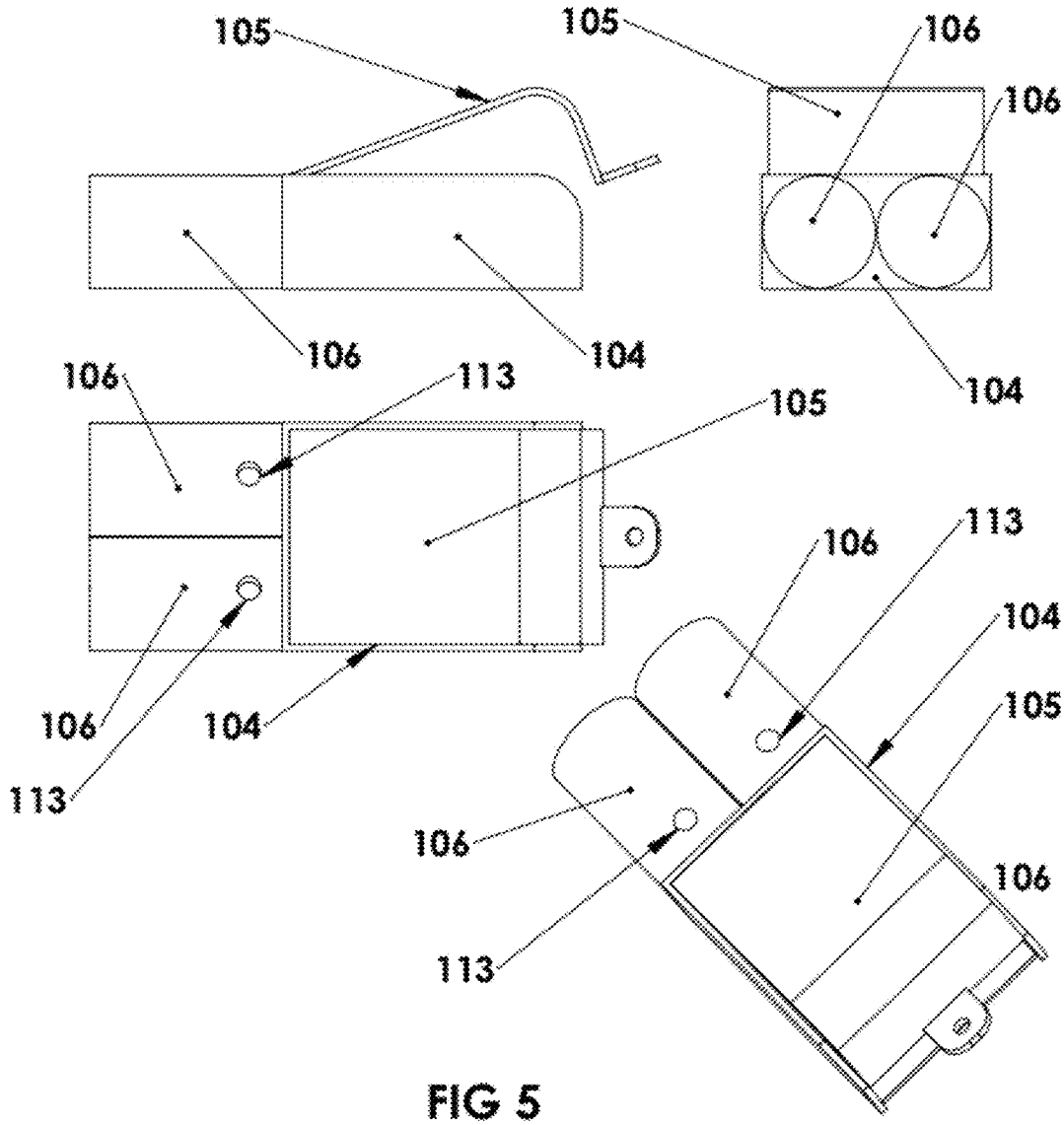
FIG. 5, Housing with protective cover lid and container for gas filled metal cylinders for projecting triangular tubes from the firing chamber.

Another embodiment of said present invention is shown in FIG. 5 where an assembled arrangement of said gas filled cylinder solenoid member means 106 are physically attached and secured to said gas cylinder housing member means 104, and said gas cylinder member means 115 (hidden from view in this illustration, but represented in FIG. 1, FIG. 3, and FIG. 6) are screwed into threaded portal member means 113 of said gas filled cylinder solenoid member means 106. A hinged lid cover member means 105 that is connected to said gas cylinder housing member means 104, protects said gas cylinders 115 from exposure that may cause pre-triggering by external foreign objects accidently piercing said gas cylinders 115 and for the prevention of unauthorized personnel obtaining access to, and tampering with, said gas cylinder member means 115.

Figure 6:
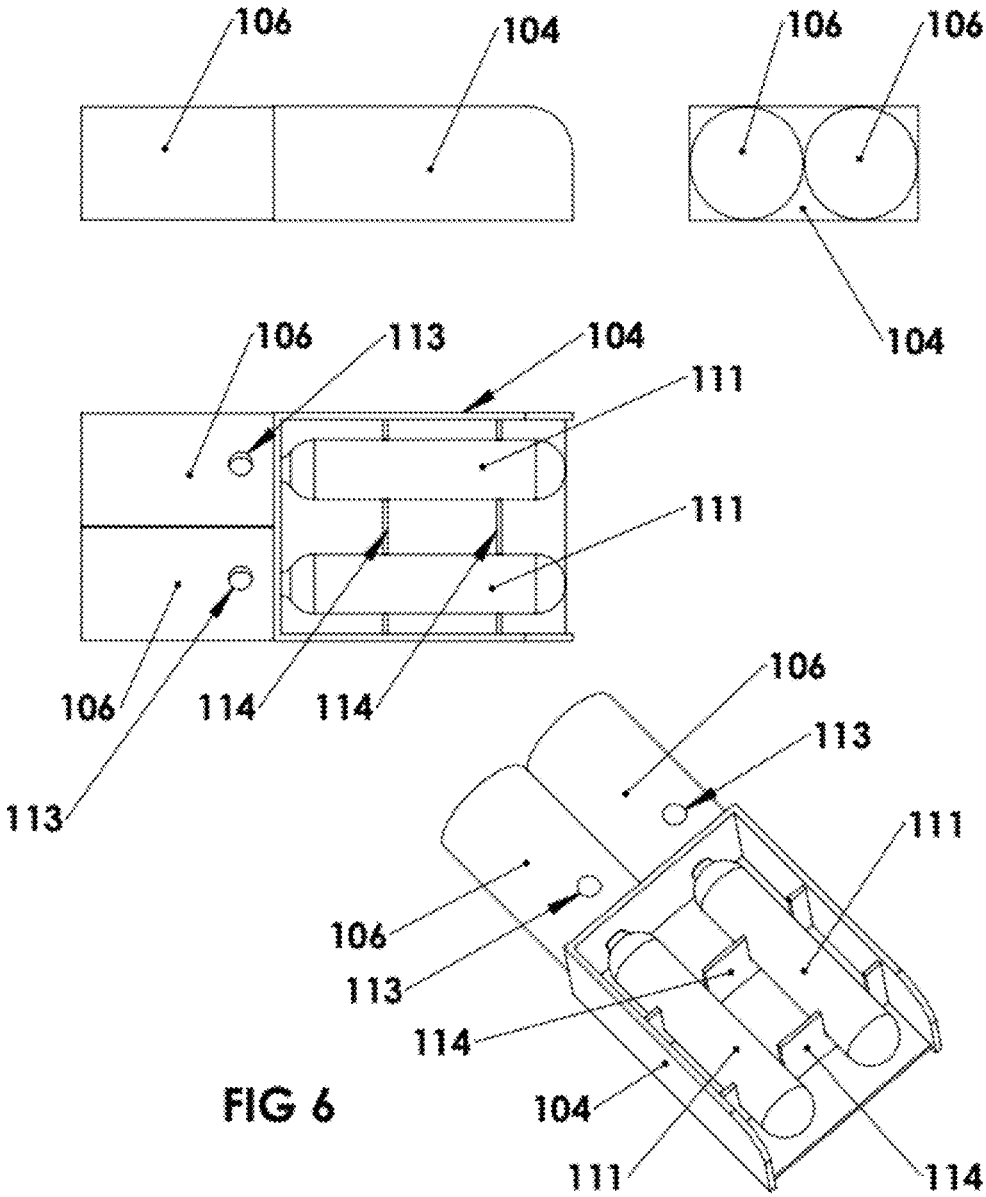
FIG. 6, a perspective view of gas cylinder container showing the position and arrangement of gas filled cylinders.

Another embodiment of said present invention in FIG. 6, illustrates where said gas filled cylinder member means are inserted into said cylinder bed member means 114 used as a method means to eliminate any stress or strain on said gas cylinder member means 111 that is screwed into said gas filled cylinder solenoid member means 106. This method means prevents any false accidental instant gas release from said gas filled cylinders 111.

Figure 7:
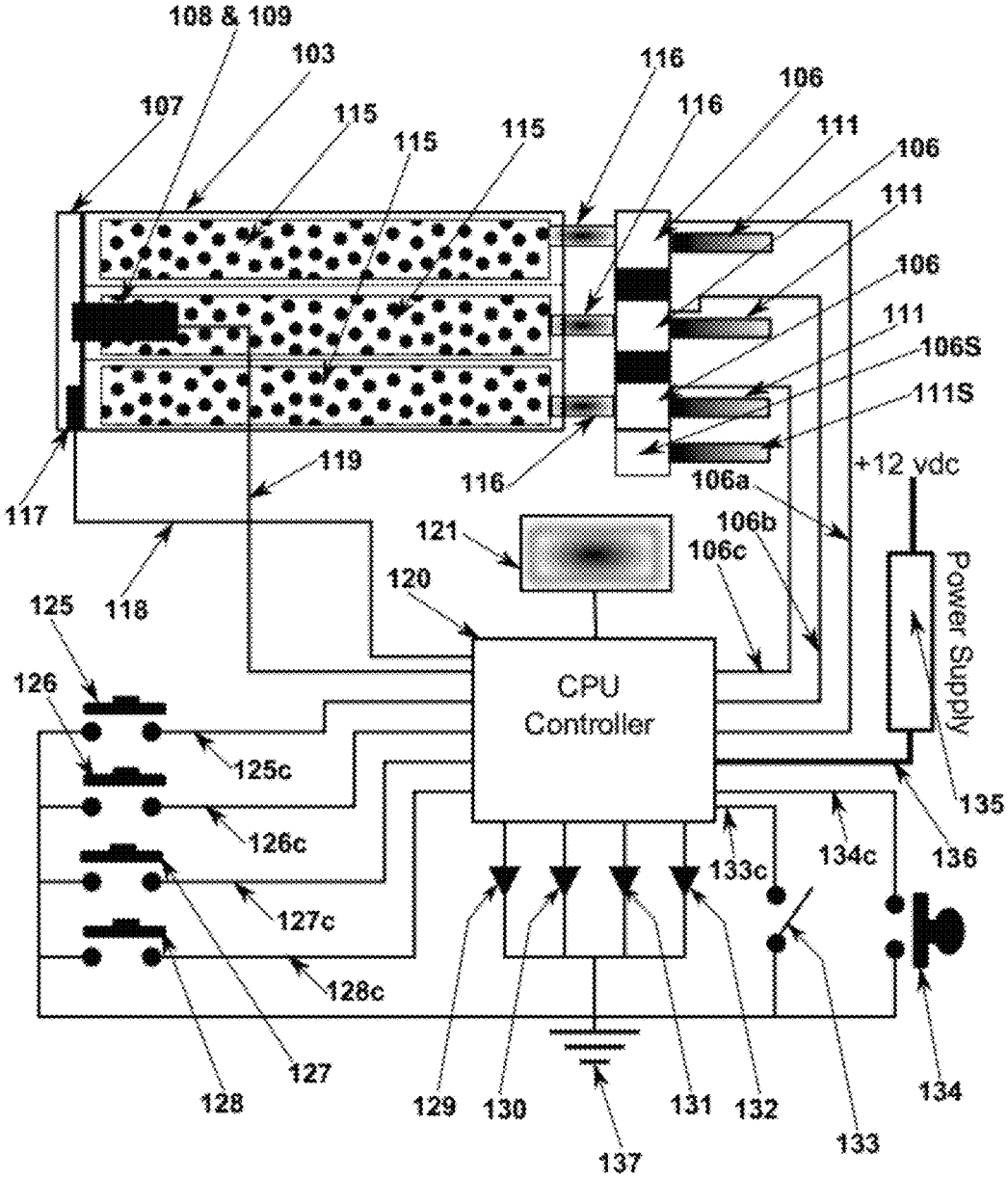
FIG. 7, a functional block diagram of the present invention.

As presented in FIG. 7, a microprocessor (CPU) 120 is operational and programmed as the core for the fail-safe operation of said present invention. Said microprocessor (CPU) 120 is housed within a control panel enclosure (not shown, but should be obvious to anyone steeped in the art) that is physically situated within a law enforcement vehicle and has a connecting cable (not shown, but should be obvious to anyone steeped in the art) that runs from inside said vehicle to the outside of said vehicle and connected to the associated remaining members of said present invention. For said present invention's operation, a driver, law officer, or other passenger so designated to operate same can sit with said control panel enclosure and when it is determined that a suspect vehicle is within a reasonable range of effectiveness for proper operation. Said operator with control panel first arms the system by flipping member means, ARM SWITCH 133. Now said microprocessor (CPU) 120 takes over to sequence through a pre-programmed algorithm that waits for a FIRE COMMAND; said FIRE COMMAND is displayed on alphanumeric display 121 for the operator's viewing. When said operator makes a decision to fire the system 100, said operator pushes a mushroom "FIRE" labeled momentary contact pushbutton switch member means 134 and a signal is sent along wire member means 134*c* to said microprocessor (CPU) 120. Depending upon programmed settings and either all of said hollow triangular tube(s) member means 115 that contains within, a supply of sharp multi-directional spiked quills can be fired simultaneously, or they can be fired in a time delayed sequence one at a time. Said firing sequence is executed as the microprocessor (CPU) 120 sends a signal along a wire 119 first to door 107 latch 108 and its associated solenoid 109 to open said door 107, and then sends a firing signal to all of said gas filled cylinder solenoid member means 106 by said cable (not shown, but should be obvious to anyone steeped in the art) along wire member means 106*a*, 106*b*, and 106*c* inclusive.

NOTE: A spare gas filled cylinder solenoid member means 106S is a member of said present invention for obvious reasons and functioning to anyone steeped in the art.

Said gas filled cylinder solenoid member means 106 are connected to said gas filled cylinders 111 and are securely screwed in said gas filled cylinder solenoid member means 106 and said cylinders 111 lay in said cylinder bed member means 114 used as a method means to eliminate any stress or strain on said gas cylinder member means 111 that is screwed into said gas filled cylinder solenoid member means 106. Further, said gas filled cylinders 111 are connected by flexible plastic hose (not shown, but should be obvious to anyone steeped in the art) to supply a blast of gas for propulsion and ejection of said hollow triangular tube(s) member means 115 that contains within, a supply of sharp multi-directional spiked quills.

A sensor member means 117 is mounted and positioned on the firing cylinder door 107 and detects whether said door member means 107 is open "after a firing sequence" and a signal is sent to said microprocessor (CPU) member means 120 by a wire member means 118 that tells said microprocessor (CPU) 120 to reset and wait for another "FIRE" COMMAND signal from switch member means 134.

Further in FIG. 7, there are four indicator LED member means 129, 130, 131, & 132 that serve as visual signal indicators as to "SYSTEM ARMED" LED 129, "READY TO FIRE" LED 130, "STATUS" LED 131, & "FAULT" LED 132. Their functions should be obvious to anyone steeped in the art. The momentary pushbutton switch member means 125, 126, 127, & 128 enable through a grounding contact 137, a series of functions that perform a system test with switch 125, a status report switch 126, a reset switch 127, & a sensor and sequence test switch 128. Power supply member means 135 for said present invention is contained within said control panel enclosure member means and is powered by said vehicle's 12 volt battery and supplies a regulated voltage means by power bus member means 136 to all of the electrical components used in said present invention.

What is claimed is:

1. An ejection device for attaching to a push-bar of a first vehicle and for deflating tires of a second vehicle, comprising:

a) a housing;

b) a propelling system; and c) a microprocessor;

wherein said housing is for attaching to the push-bar of the first vehicle;

wherein said housing contains at least one hollow triangular tube filled with sharp metal multi-directional spiked quills;

wherein said propelling system ejects said at least one hollow triangular tube filled with sharp metal multi-directional spiked quills out of said housing; and wherein said microprocessor controls a firing sequence of events to fire said at least one hollow triangular tube filled with sharp metal multi-directional spiked quills out of said housing.

2. The device of claim 1, further comprising sensors; and wherein said sensors are mounted on said housing.

3. The device of claim 2, wherein said microprocessor has an algorithm; and wherein said algorithm of said microprocessor interrogates said system sensors to ensure fail-safe operation of said device.

4. The device of claim 3, further comprising a programmer; and wherein said programmer programs said microprocessor to modify said algorithm of said microprocessor.

5. The device of claim 1, further comprising:

a) a power cable;

b) a power switch; and c) an ejection button;

wherein said power cable is for connecting said housing to the first vehicle;

wherein said power cable is connected to said power switch; and wherein said power cable is connected to said ejection button.

6. The device of claim 5, further comprising at least one release member; and wherein said at least one hollow triangular tube filled with sharp metal multi-directional spiked quills is for being launched onto a road surface in order to stop the second vehicle.

7. The device of claim 6, further comprising an ejection door;

wherein said at least one release member is activated by said ejection button;

wherein one said at least one release member activates said propelling system;

wherein another said at least one release member opens said ejection door and proceeds to launch said at least one hollow triangular tube filled with sharp metal multi-directional spiked quills therethrough.

8. The device of claim 7, wherein said at least one release member activates said propelling system and launches said at least one hollow triangular tube filled with sharp metal multi-directional spiked quills from the first vehicle to deflate the tires of the second vehicle.

9. The device of claim 1, further comprising:

a) a container; and b) at least one gas filled cylinder;

wherein said container contains said at least one gas-filled cylinder; and wherein said at least one gas-filled cylinder functions as a propellant to launch said at least one hollow triangular tube filled with sharp metal multi-directional spiked quills out of said housing.

10. The device of claim 9, further comprising a solenoid; and wherein said at least one gas-filled cylinder is connected to said solenoid.

11. The device of claim 10, further comprising a flexible tubing; and wherein said at least one gas-filled cylinder and said solenoid instantly transfer via said flexible tubing a forced supply of gas contained within said at least one gas-filled cylinder to launch said at least one hollow triangular tube filled with sharp metal multi-directional spiked quills at a time period that is one of simultaneously and a time-delayed sequence of said at least one hollow triangular tube filled with sharp metal multi-directional spiked quills.

12. The device of claim 1, wherein said at least one hollow triangular tube filled with sharp metal multi-directional spiked quills has a pressure;

wherein said at least one hollow triangular tube filled with sharp metal multi-directional spiked quills has a trajectory once ejected;

wherein said at least one hollow triangular tube filled with sharp metal multi-directional spiked quills has an internal adjustment;

wherein said internal adjustment of said at least one hollow triangular tube filled with sharp metal multi-directional spiked quills individually adjusts said pressure of said at least one hollow triangular tube filled with sharp metal multi-directional spiked quills to influence said trajectory of said at least one hollow triangular tube filled with sharp metal multi-directional spiked quills; and wherein said internal adjustment of said at least one hollow triangular tube filled with sharp metal multi-directional spiked quills provides a sequence of firing that places said at least one hollow triangular tube filled with sharp metal multi-directional spiked quills on a desired road surface at a predetermined distance away from each other to completely cover the road surface for insuring stoppage of the second vehicle.

13. The device of claim 1, further comprising a regulated power supply; and wherein said regulated power supply is for converting battery power of the first vehicle to a regulated voltage supply to power said device.

14. The device of claim 1, further comprising:

a) said push-bar;

b) an under guard cover; and c) a frontal guard cover;

wherein said under guard cover and said frontal guard cover are a part of said push-bar to protect said device from any foreign objects that might be of potential threat to proper operation of said device.

15. The device of claim 14, further comprising installing components; and wherein said installing components install said device on said push-bar.

16. The device of claim 1, further comprising an alphanumeric display;

wherein said alphanumeric display is part of said housing; and wherein said alphanumeric display is for communicating with an operator of said device.

17. The device of claim 16, further comprising:

a) a series of switches; and b) various control functions;

wherein said series of switches test said various control functions; and wherein said various control functions have information available to view on said alphanumeric display by the operator for monitoring any information necessary to operate said device.

* * * * *